US005934547A

United States Patent [19]

Vaughn et al.

[11] Patent Number: 5,934,547

[45] Date of Patent: Aug. 10, 1999

[54] BRIDGED TAB CUT FOR SPIRAL WOUND CONTAINER

[75] Inventors: James Vaughn, North Lawrence; Joseph Forte, Canton, both of Ohio

[73] Assignee: Crown Cork & Seal Technologies Corporation, Alsip, Ill.

[21] Appl. No.: 09/014,790

[22] Filed: Jan. 28, 1998

[51] Int. Cl.[6] ..... B65D 3/26

[52] U.S. Cl. ..... 229/4.5; 229/201; 229/237

[58] Field of Search ..... 229/4.5, 201, 202, 229/237

[56] References Cited

U.S. PATENT DOCUMENTS

| | | | |
|---|---|---|---|
| 2,051,923 | 8/1936 | Vogt | 229/4.5 |
| 2,793,127 | 5/1957 | Geist et al. | 229/202 |
| 3,221,975 | 12/1965 | Zoeller et al. | 229/201 |
| 4,257,316 | 3/1981 | Roder et al. | 493/68 |
| 4,295,840 | 10/1981 | Sansbury | 493/278 |
| 5,076,440 | 12/1991 | Drummond | 229/202 |
| 5,318,499 | 6/1994 | Rice et al. | 493/287 |
| 5,487,506 | 1/1996 | Drummond et al. | 229/202 |
| 5,547,451 | 8/1996 | Drummond et al. | 493/299 |
| 5,556,365 | 9/1996 | Drummond et al. | 493/299 |

*Primary Examiner*—Gary E. Elkins

*Attorney, Agent, or Firm*—Woodcock Washburn Kurtz Mackiewicz & Norris LLP

[57] ABSTRACT

A spiral wound type composite container of the type that is typically used for packaging refrigerated pressurized dough products includes, as is typical in such containers, an inner liner, a body wall that is wound about the inner layer so as to define a butt joint, and a label member that is wound about the body wall so as to bind the body wall against expansion as a result of forces that are created by the pressurized contents of the container. As is also typical in such containers, the label member has a tab defined at one portion thereof and a predetermined lead path forming the tab so that a consumer can grasp the tab and tear the label member along the lead path, thereby removing enough of the label member from the body wall so that forces of pressurization will cause the body wall to separate and open. According to one novel aspect of the invention, the lead path is defined on a portion of the label member by at least two discrete cuts, with adjacent cuts being separated by a bridge area, so that the portion of the label member in which the lead path is defined will be strong enough to avoid flagging and premature opening during manufacture and handling, yet will be of an adequate length to reduce the potential of premature mis-directional tearing of the label during opening by a consumer.

11 Claims, 6 Drawing Sheets

BRIDGED TAB CUT FOR SPIRAL WOUND CONTAINER

BACKGROUND OF THE INVENTION

1. Field of the Invention

This invention relates to an easy-open composite container for packaging various products, particularly products under pressure such as biscuit and bread dough and the like.

2. Description of the Related Technology

Easy-open composite containers for packaging various products, particularly products under pressure, such as refrigerated dough products, are in common use throughout the world. These containers are usually formed of a spirally-wound paperboard or board stock body wall, an interior or liner layer for preventing leakage of the contents from the container and an exterior label. The body wall is wound in such a manner as to form a tight spiral butt joint at its edges. The label is typically wound about the body wall and is secured so as to bind the body wall against expansion as a result of forces that are created by the pressurized contents of the container.

In many containers of this type, the label member possesses an integral gripping tab for the purpose of opening the container by means of a predetermined single lead cut, so that the consumer can grasp the tab and tear the label member along a lead path, thereby removing enough of the label member from the body wall so that the forces of pressurization will cause the body wall to separate at the butt joint, thereby opening the container.

One problem that is present in containers of the type described above is that the tab will tend to delaminate from the container and stick outwardly, in an effect that is termed "flagging" by those, such as the inventors herein, who are familiar with this area of technology. The longer the lead cut, the greater the potential for flagging. However, if the: lead cut is made too short, the risk of mis-directional tearing during the opening process increases. When this happens, the consumer may pull the tab so as to rip the label in a direction that deviates from the intended lead path, which can result in not enough of the body wall being exposed to cause the container to properly open as described above.

It is clear that a need exists for an improved spiral wound type container for packaging pressurized products such as refrigerated dough that has reduced potential for both tab flagging and mis-directional tearing during opening.

SUMMARY OF THE INVENTION

Accordingly, it is an object of the invention to provide an improved spiral wound type container for packaging pressurized products such as refrigerated dough that reduces the potential for both tab flagging and mis-directional tearing during opening.

In order to achieve the above and other objects of the invention, a spiral wound type composite container of the type that is typically used for packaging pressurized dough products, includes an inner liner; a body wall that is wound about the inner layer so as to define a butt jointed edge; and a label member that is wound about the body wall so as to bind the body wall against expansion as a result of forces that are created by the pressurized contents of the container, the label member having a tab defined at one portion thereof and a predetermined lead path defined adjacent to the tab whereby a consumer can grasp the tab of the label member and tear the label member along the lead path, thereby removing enough of the label member from the body wall so that forces of pressurization will cause the body wall to separate at the butt joint, thereby opening the container; and wherein the lead path is defined on a portion of the label member by at least two discrete cuts, with adjacent cuts being separated by a bridge area, so that the portion of the label member in which the lead path is defined will be strong enough to avoid premature opening during manufacture and handling, yet will be of an adequate length to reduce the potential of premature mis-directional tearing of the label during opening by a consumer.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
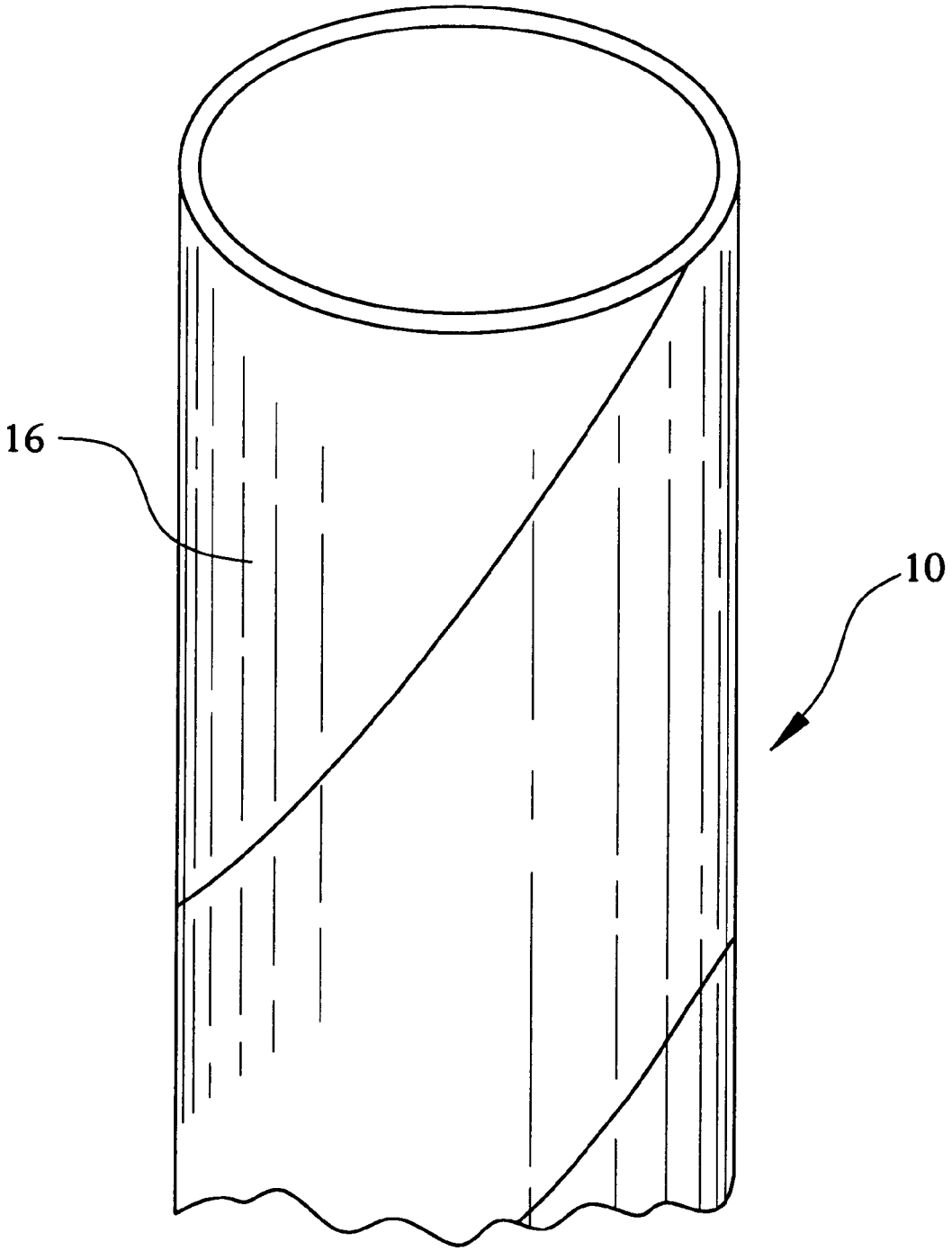
FIG. 1 PRIOR ART
FIG. 1 is a fragmentary perspective view of a conventional spiral wound type container.
Figure 2:
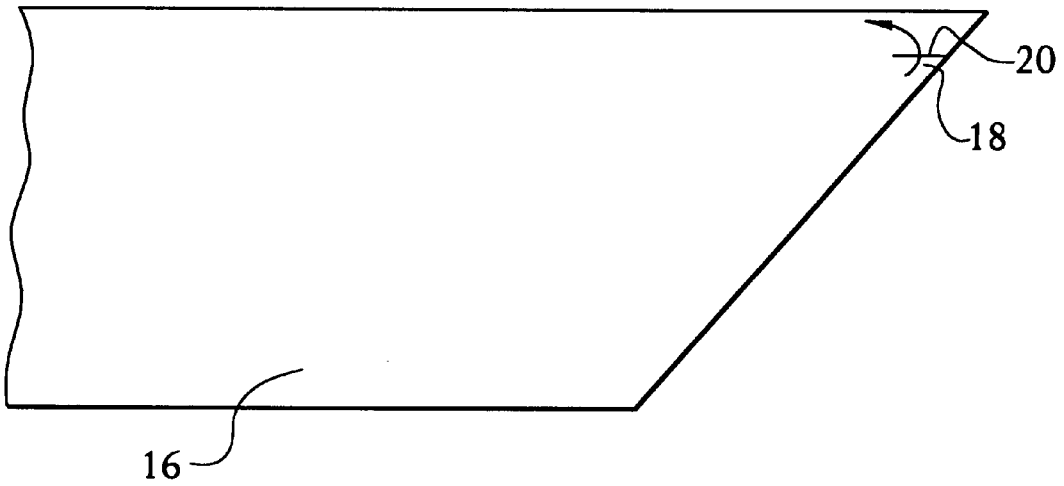
FIG. 2 PRIOR ART
FIG. 2 is a diagrammatical depiction of a conventional outer label and tab cut.
Figure 3B:
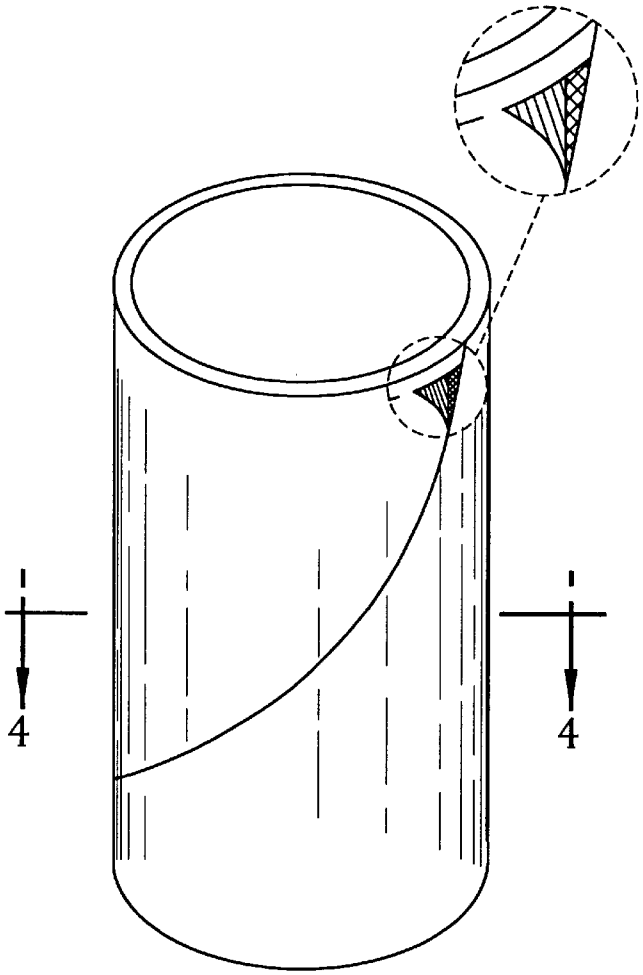
FIGS. 3A and 3B are, respectively, a fragmentary perspective view of a spiral wound type container according to a preferred embodiment of the invention shown in first and second modes of operation.
Figure 3A:
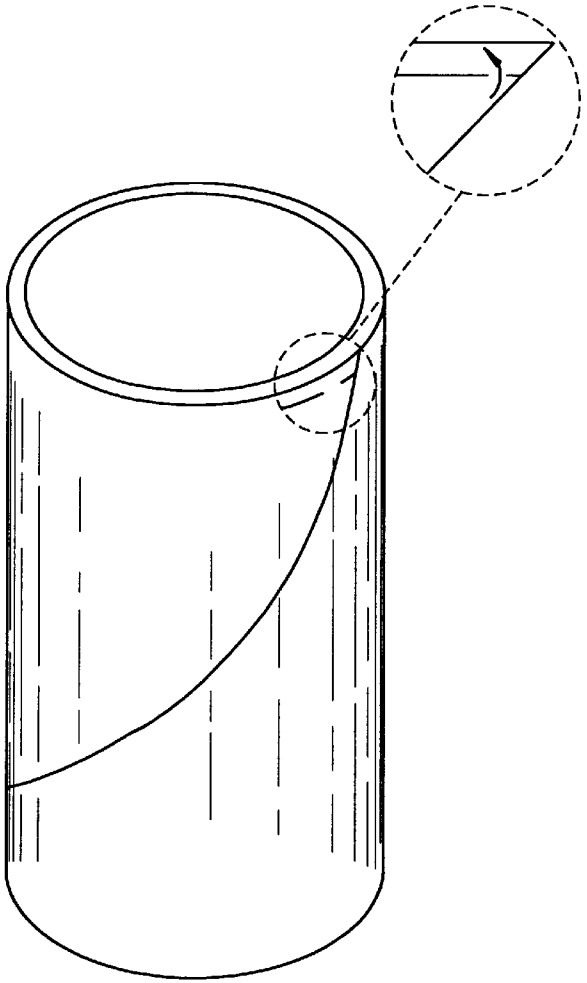
Figure 4:
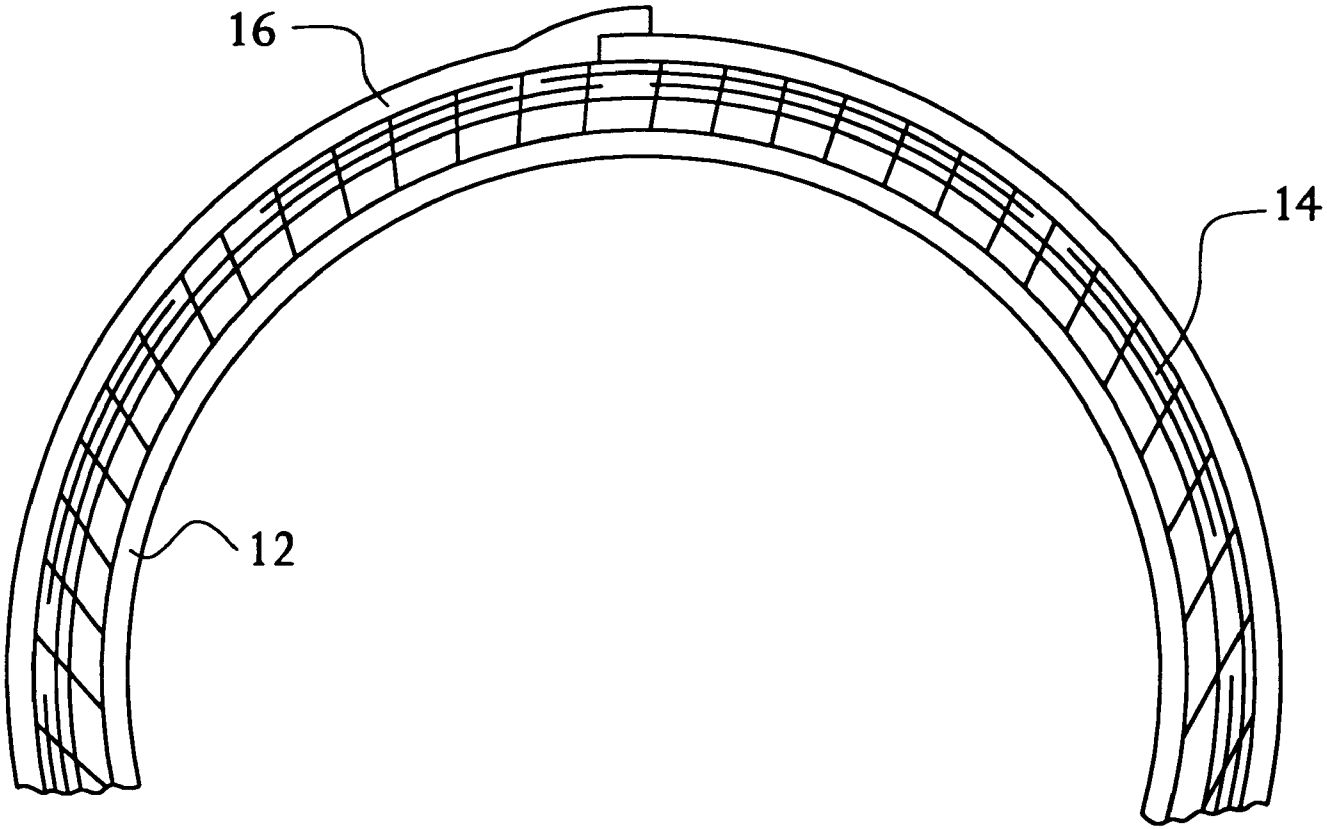
FIG. 4 is a fragmentary cross-sectional view taken along lines 4—4 in FIG. 3B.

Referring now to the drawings, wherein like reference numerals designate corresponding structure throughout the views, and referring in particular to FIGS. 1, 2 and 3, a conventional a spiral wound type composite container 10 of the type that is in common use for packaging pressurized material such as refrigerated bread dough includes, as may best be seen in FIG. 4, an inner liner 12, a body wall 14 that is wound about the inner liner 12 so as to define a butt jointed edge, and a label member 16 that is wound about the body wall 14. As is conventional, the inner liner 12 in the preferred embodiment is formed from a foil material that has a backing of light kraft paper, but can alternatively be formed from any flexible material such as paper, foil, polymeric substrates and laminates thereof that are substantially impermeable to moisture, grease, and gasses. The body wall 14 is preferably formed from kraft or heavy paperboard of varying but conventional thickness. The thickness must be sufficient to provide structural support to withstand the selected environment. As is also conventional, the label member 16 typically contains printed matter, such as an illustration or directions, and serves to protect the body wall 14 from moisture. Appropriate materials for label member 16 may include paper, foil, film, emulsions, coatings and laminates of these materials. The label member 16 is bonded to the body wall by an adhesive that will permit the label member 16 to delaminate from the body wall when pulled with sufficient force during opening. The label member 16 is secured about the body wall 14 sufficiently to bind the body wall 14 against expansion as a result of forces that are created by the pressurized contents of the container 10.

As may be seen in FIG. 2, the conventional label member 16 possesses an integral gripping tab 18 and has a predetermined lead path defined thereon adjacent to the gripping tab 18 by a single lead cut 20, so that a consumer can grasp the label member 16 by the tab grip 18 to tear the label member 16 along the lead path, thereby removing enough of the label member 16 from the body wall 14 that the forces of pressurization will cause the body wall 14 to separate at the butt joint, thereby opening the container 10. As has been discussed above, this type of product design is susceptible to the problem of "flagging." The longer the lead cut 20, the greater the potential for flagging. However, if the lead cut 20 is made too short, the risk of mis-directional tearing during the opening process increases. When this happens, the consumer may pull the tab 18 so as to rip the label in a direction that deviates from the intended lead path, which can result in not enough of the body wall 14 being exposed to cause the container to properly open as described above.

Figure 5:
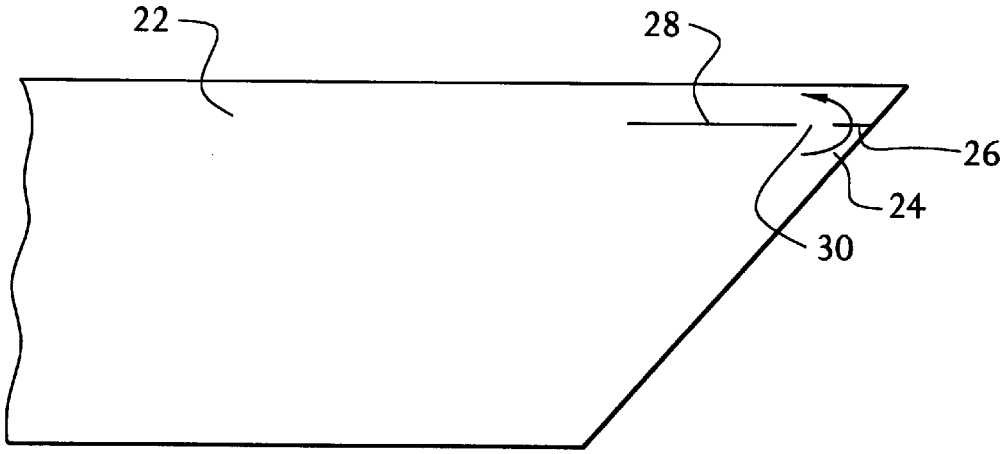
FIG. 5 is a diagrammatical depiction of an outer label and tab cut according to a first embodiment of the invention.

Referring now to FIG. 5, a label 22 for a spiral wound container according to preferred embodiment of the invention will now be discussed. As may be seen in FIG. 5, label 22 includes an integral gripping tab 24 and has a predetermined lead path defined thereon adjacent to the gripping tab 24 by two discrete cuts 26, 28, with the adjacent cuts being separated by a bridge area 30, so that the portion of said label member 22 in which the lead path is defined will be strong enough to avoid flagging and premature opening during manufacture and handling, yet will be of an adequate length to reduce the potential of premature mis-directional tearing of the label during opening by a consumer.

Figure 6:
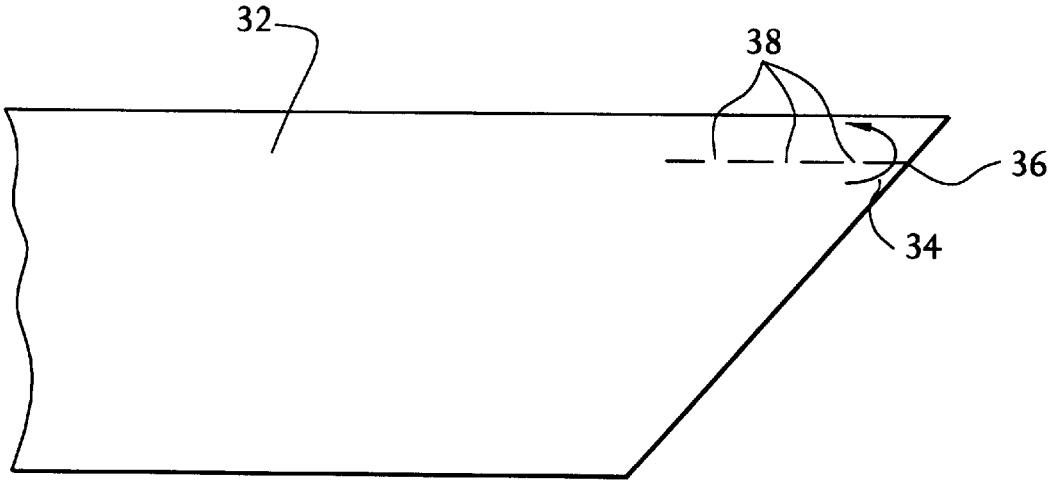
FIG. 6 is a diagrammatical depiction of an outer label and tab cut according to a second embodiment of the invention.

Referring to FIG. 6, a label 32 for a spiral wound container that is constructed according to a second preferred embodiment of the invention includes an integral gripping tab 34 and has a predetermined lead path defined thereon adjacent to the gripping tab 34 by a plurality of aligned discrete cuts 36, with adjacent cuts 36 being separated by bridge areas 38. As in the previously described embodiment, this construction will ensure that the portion of the label member 32 in which the lead path is defined will be strong enough to avoid flagging and premature opening during manufacture and handling, yet will be of an adequate length to reduce the potential of premature mis-directional tearing of the label during opening by a consumer.

The bridges 30, 38 in the above-described embodiments preferably are constructed to have a width that is within an outer preferred range of about 0.070 inches to about 0.110 inches, and within an inner preferred range of about 0.080 inches to about 0.090 inches. Most preferably, the bridge areas have a width of about 0.080 inches.

Figure 7:
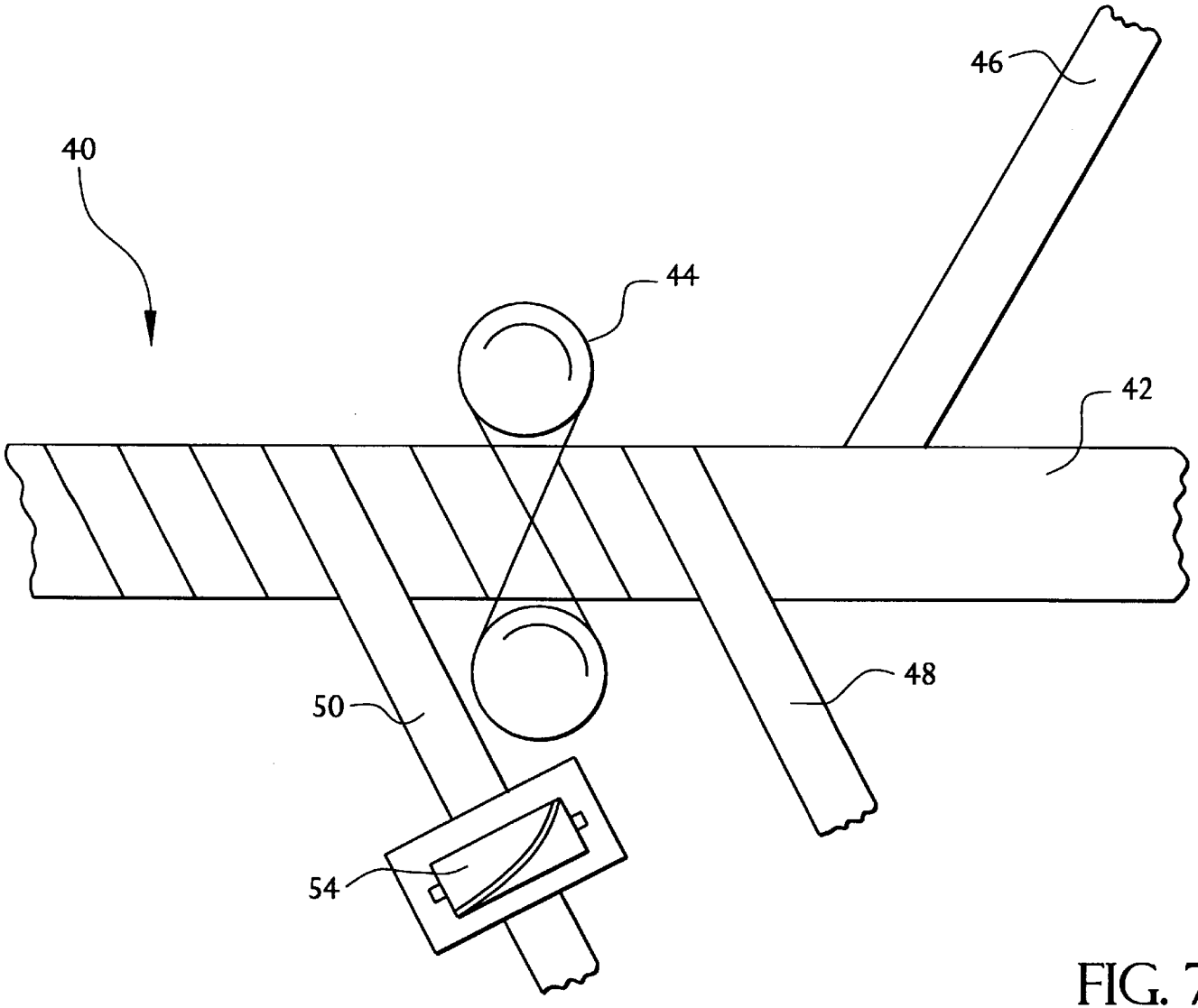
FIG. 7 is a schematic depiction of a system for making containers according to the invention.

Looking now to FIG. 7, spiral winding is the preferred process for manufacturing the tab cut spiral wound containers. Accordingly, the process will now be discussed. The spiral winding process is accomplished through the use of a system 40 that includes a continuous spiral wrapped driver belt 44 wrapped around a stationary mandrel 42. The driver belt brings together the composite materials at a particular angle to form a composite tube. As may be seen in FIG. 7, provided in system 40 are a supply 46 of liner material, a supply 48 of body wall material, and a supply 50 of label material. System 40 is set up so that these materials meet at a predetermined angle with respect to the cylindrical axis of the mandrel.

As the winding belt 44 rotates, a continuous strip of inner liner material 46 is deposited onto the mandrel 42 of the winder. Next, a continuous strip 48 of fibrous body wall material which is adhesively coated on the surface facing the impermeable inner liner layer 46 is deposited onto the mandrel. The abutting edges of the fibrous body wall material 48 define the helical butt joint discussed above. As the winding belt 44 rotates, the impermeable inner liner 46 and the body wall material 48 are joined and form a continuous, cylinder. A helical joint defined by overlapping edges of the inner liner 46 preferably includes a heat sealed anaconda fold proximate the butt joint. A label layer 50 is then adhesively applied to the body wall layer 48, after the label material is scored or cut by a tab cutting station 54. At station 54, cuts 26, 28 and bridge 30 are made, in the case of the first embodiment, or the cuts 36 and bridges 38 are made, in the case of the second embodiment. In the preferred embodiment, scoring station 54 includes a scalloped rotary blade for forming the respective cuts and bridges.

The formed tube is then cut to a plurality of discrete lengths. An end member is preferably placed onto one end of the container prior to inserting a dough product. After inserting the product, the container may be sealed by applying a second end member (not shown) to the open end.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A spiral wound type composite container such as that typically used for packaging pressurized dough products, comprising:

an inner liner;

a body wall that is wound about said inner liner so as to define a butt joint on edges thereof; and a label member that is wound about said body wall so as to bind said body wall against expansion as a result of forces that are created by the pressurized contents of the container, said label member having a tab defined at one portion thereof and a predetermined lead path defined adjacent to said tab whereby a consumer can grasp said label member and tear said label member along said lead path, thereby removing enough of said label member from said body wall so that forces of pressurization will cause said body wall to separate at said butt joint, thereby opening the container; and wherein said lead path is defined by at least two discrete cuts formed in said label member and separated by a bridge area formed in said label member, so that the portion of said label member in which said lead path is defined will be strong enough to avoid premature opening during manufacture and handling, yet will be of an adequate length to reduce the potential of premature mis-directional tearing of the label during opening by a consumer.

2. A container according to claim 1, wherein said body wall comprises kraft paper.

3. A container according to claim 1, wherein said label member is bonded to said body wall by an adhesive that will permit said label member to delaminate from said body wall when pulled with sufficient force without tearing said body wall.

4. A container according to claim 1, wherein said lead path is defined on said label member by two discrete cuts, with a single bridge area defined between said two discrete cuts.

5. A container according to claim 4, wherein said single bridge area has a width of about 0.070 inches to about 0.110 inches.

6. A container according to claim 5, wherein said single bridge area has a width of about 0.080 inches to about 0.090 inches.

7. A container according to claim 6, wherein said single bridge area has a width of about 0.080 inches.

8. A container according to claim 1, wherein said lead path is defined on said label member by a plurality of successive discrete cuts and a plurality of bridge areas, with one of said bridge areas defined between each successive cut.

9. A container according to claim 8, wherein said bridge areas have a width of about 0.070 inches to about 0.110 inches.

10. A container according to claim 9, wherein said bridge areas have a width of about 0.080 inches to about 0.090 inches.

11. A container according to claim 10, wherein said single bridge areas have a width of about 0.080 inches.

* * * * *